United States Patent [19]

Bunch, Jr.

[11] 4,380,448

[45] Apr. 19, 1983

[54] PAPER STOP ADJUSTMENT MECHANISM FOR CONTINUOUS FORM STATIONERY FOLDING MACHINE

[75] Inventor: Earnest B. Bunch, Jr., Peoria, Ariz.

[73] Assignee: B. Bunch Company, Inc., Phoenix, Ariz.

[21] Appl. No.: 189,787

[22] Filed: Sep. 22, 1980

[51] Int. Cl.[3] ..... B65H 45/00; B65H 45/20

[52] U.S. Cl. ..... 493/410; 493/413; 493/441

[58] Field of Search ..... 493/409–414, 493/418, 423, 450, 441

[56] References Cited

U.S. PATENT DOCUMENTS

| | | | |
|---|---|---|---|
| 2,675,747 | 4/1954 | Greiner | 493/433 X |
| 3,352,553 | 11/1967 | Preston | 493/413 |
| 3,711,085 | 1/1973 | Bunch | 493/413 X |

FOREIGN PATENT DOCUMENTS

| | | | |
|---|---|---|---|
| 1002623 | 8/1965 | United Kingdom | 493/414 |

*Primary Examiner*—A. J. Heinz

*Attorney, Agent, or Firm*—Drummond, Nelson & Nissle

[57] ABSTRACT

Improved apparatus for producing continuous form stationery by folding a strip of paper along lines of weakening formed therein. The apparatus includes a frame; endless belt units mounted on the frame for alternately distributing successive lines of weakening in the paper in substantially opposite directions, each belt unit including a distribution roller adjacent and parallelably disposed to a roller in the companion belt unit; a feed roller for directing the continuous strip of paper between the adjacent distribution rollers; a support surface for receiving paper distributed by the endless belt units; a mechanism for periodically tamping the paper distributed by the endless belt units, the tamping mechanism assisting in the folding and positioning the paper on the support surface; and, a pair of paper stop assemblies positioned above the support surface, each of the paper stop assemblies being spaced apart from the other and on an opposite side of a midline lying between and parallel to the adjacent distribution rollers and having at least one upstanding face for stopping the lateral travel of creased edges of paper distributed away from the midline by the endless belt units. The improvement consists of providing paper stop assemblies which can be positioned beneath the distribution rollers so that the continuous strip of paper can be folded into short segments.

2 Claims, 10 Drawing Figures

PAPER STOP ADJUSTMENT MECHANISM FOR CONTINUOUS FORM STATIONERY FOLDING MACHINE

This invention relates to improved apparatus for producing continuous form stationery by folding a strip of paper along transverse lines of weakening formed therealong.

More particularly, the invention concerns an improved stationery folding machine of the type having a feed roller which directs a continuous strip of paper between first and second endless belt units which distribute successive lines of weakening in the paper in substantially opposite directions, each endless belt unit having a roller adjacent to and parallelably disposed with respect to a roller in the companion endless belt unit, the continuous strip of paper dispensed by the feed roller traveling between the adjacent rollers and being distributed by the endless belts carried thereon.

In another respect, the invention concerns an improved paper folding machine of the type having a feed roller for directing a continuous strip of paper between a pair of adjacent rollers carrying endless belts which distribute successive lines of weakening formed in the paper in substantially opposite directions and having a pair of paper stop assemblies spaced apart at opposite sides of a midline lying between and parallel to the adjacent rollers, each of the stop assemblies having at least one generally vertical face for engaging and stopping the horizontal travel of the creased edges of paper distributed by the endless belts.

In a further respect, the invention relates to an improved paper folding machine of the type described in which the upstanding crease engaging faces of the paper stop assemblies may be positioned beneath the adjacent paper distribution rollers so that the machine can fold paper in lengths shorter than the combined diameters of the adjacent pair of distribution rollers.

In still a further respect, the invention relates to an improved paper folding machine of the type described which generally prevents creased edges of paper distributed by the endless belt units from traveling between the bottom of the distribution rollers and the top portions of the crease engaging faces when the paper stop assemblies are positioned beneath the adjacent paper distribution rollers.

The general type of paper folding machine described in U.S. Pat. No. 3,352,553 to Preston has achieved wide commercial acceptance since it was introduced on the market. While the apparatus described in the Preston patent has undergone substantial improvements, some of which are described in the U.S. Pat. No. 3,711,085 to Bunch, Jr., the basic operational combination still consists of a feed roller for directing a strip of paper between a pair of endless belt units which distribute the paper in a zig-zag fashion, of a pair of tamping mechanisms for periodically compressing creased paper distributed by the endless belt units to facilitate the folding and positioning thereof, and of a pair of paper stop assemblies for stopping the lateral travel of creased edges of paper distributed by the endless belt units. Each endless belt unit includes a roller adjacent and parallelably disposed to a roller in the companion belt unit. Endless belts moving over this pair of adjacent rollers cause lines of weakening in paper fed between the adjacent rollers to be alternately distributed in generally opposite directions. A conveyor surface receives the folded paper and transports the paper to a packaging and storage station.

The paper stops are spaced apart at opposite sides of an imaginary midline located between and parallel to the adjacent distribution rollers. Each tamping mechanism is, like each associated paper stop unit, at approximately the same height from the conveyor surface as the distribution rollers and is interposed between a paper stop assembly and distribution roller. The paper stop assembly and tamping mechanism pair positioned to either side of the midline lying between the adjacent rollers is carried by support mechanism which may be laterally adjusted so that the distance between the paper stop-tamping mechanism pair and the midline can be varied depending on the length of fold desired. Thus, each paper stop assembly-tamping mechanism pair is operatively associated with and serves one of the distribution rollers.

The tamping mechanisms each include a rotating rod positioned parallel to the receiving conveyor surface and transversely of the continuous strip of paper. During operation of the paper folding machine a plurality of depending fingers projecting from the rod periodically strike and compress paper distributed by the endless belt units. In order for the tamping mechanisms to function properly, each rotating rod must in part be positioned above the low point or bottom of its companion distribution roller. As a result, the lateral adjustment of a tamping mechanism toward the midline between the adjacent distribution rollers is directly impeded by a distribution roller, and, since the tamping mechanisms are interposed between the paper stop assemblies and the distribution rollers, it is physically impossible to position the paper stop assemblies adjacent the distribution rollers. Even if the tamping mechanisms were removed from the machine, the paper stops still could not be positioned beneath the distribution rollers because a portion of the structure of both of the paper stop assemblies and associated support mechanisms is necessarily at the same height from the conveyor surface as the distribution rollers.

The inability to position the paper stop assemblies adjacent to or beneath the distribution rollers imposes a severe operational limitation on the conventional continuous form belt folding machine in that the machine cannot be utilized to fold a continuous strip of paper into segments having relatively short lengths, i.e., lengths in the range of 1.5 to 5 inches. Because the tamping mechanisms and paper stop assemblies must, in order to function properly, be at generally the same height from the conveyor surface as the distribution rollers, and because the tamping mechanisms must be positioned between the paper stops and distribution rollers, making it physically impossible to position the crease engaging faces of the paper stop assemblies beneath the distribution rollers, this operational limitation has been assumed to be a condition inherent in the construction and operation of continuous form belt folders.

Therefore, it would be highly desirable to provide improvements in paper folding machines of the type described above which would allow the crease engaging faces of the paper stop assemblies to be positioned beneath the distribution rollers so that continuous form stationery could be folded into segments having relatively short lengths. Accordingly, it is the principal objective of the present invention to provide improved apparatus for folding a strip of paper along transverse lines of weakening formed therealong into a strip of continuous form stationery having zig-zag folds therein.

Another principal objective of the invention is to provide an improved paper folding machine of the type having a feed roller which directs a continuous strip of paper between an adjacent pair of endless belt units which distribute successive lines of weakening formed in the paper in substantially opposite directions, each endless belt unit having a distribution roller adjacent to and parallelably disposed with respect to the distribution roller in the companion endless belt unit.

Still another objective of the invention is to provide an improved paper folding machine of the type having a feed roller for directing a continuous strip of paper between a pair of adjacent rollers carrying endless belts which distribute successive lines of weakening formed in the paper in substantially opposite directions and having a pair of paper stop assemblies, each of the paper stop assemblies having at least one vertical face for engaging and stopping the horizontal travel of creased paper edges distributed by the adjacent distribution rollers.

Still another and further objective of the invention is to provide an improved paper folding machine of the type described in which the crease engaging faces of the paper stop assemblies may be positioned beneath the distribution rollers so that a continuous strip of paper may be folded into segments having relatively short lengths.

These and other and further and more specific objectives and advantages of the invention will be apparent to those skilled in the art from the following detailed description thereof, taken in conjunction with the drawings, in which.

Briefly, in accordance with the presently preferred embodiment of my invention, I provide an improved apparatus for producing continuous form stationery by folding a strip of paper along transverse lines of weakening formed therein. The apparatus includes a frame; endless belt means mounted on the frame for alternately distributing successive lines of weakening in the paper in substantially opposite directions, the endless belt means including a pair of adjacent parallelably disposed rollers; means carried on the frame for directing the continuous strip of paper between the adjacent rollers; a support surface for receiving paper distributed by the endless belt means; means for periodically tamping paper distributed by the endless belt means to assist in the folding and positioning of the paper on he support surface; and, a pair of paper stop assemblies positioned above the support surface, each of the paper stop assemblies being spaced apart from the other and on an opposite side of a midline lying between and parallel to the adjacent rollers and having at least one upstanding face for engaging and stopping the lateral travel of creased edges of paper distributed away from the midline by the endless belt means.

The improvement comprises means for moving the faces of the paper stop assemblies between at least two operative positions, a first operative position with the faces positioned beneath the adjacent rollers and a second operative position with the faces moved from beneath the adjacent rollers in a direction of travel away from the imaginary midline between the adjacent rollers. The improvement enables the continuous form stationery folding apparatus to fold paper into segments having lengths less than the combined diameters of the pair of adjacent rollers.

Figure 1:
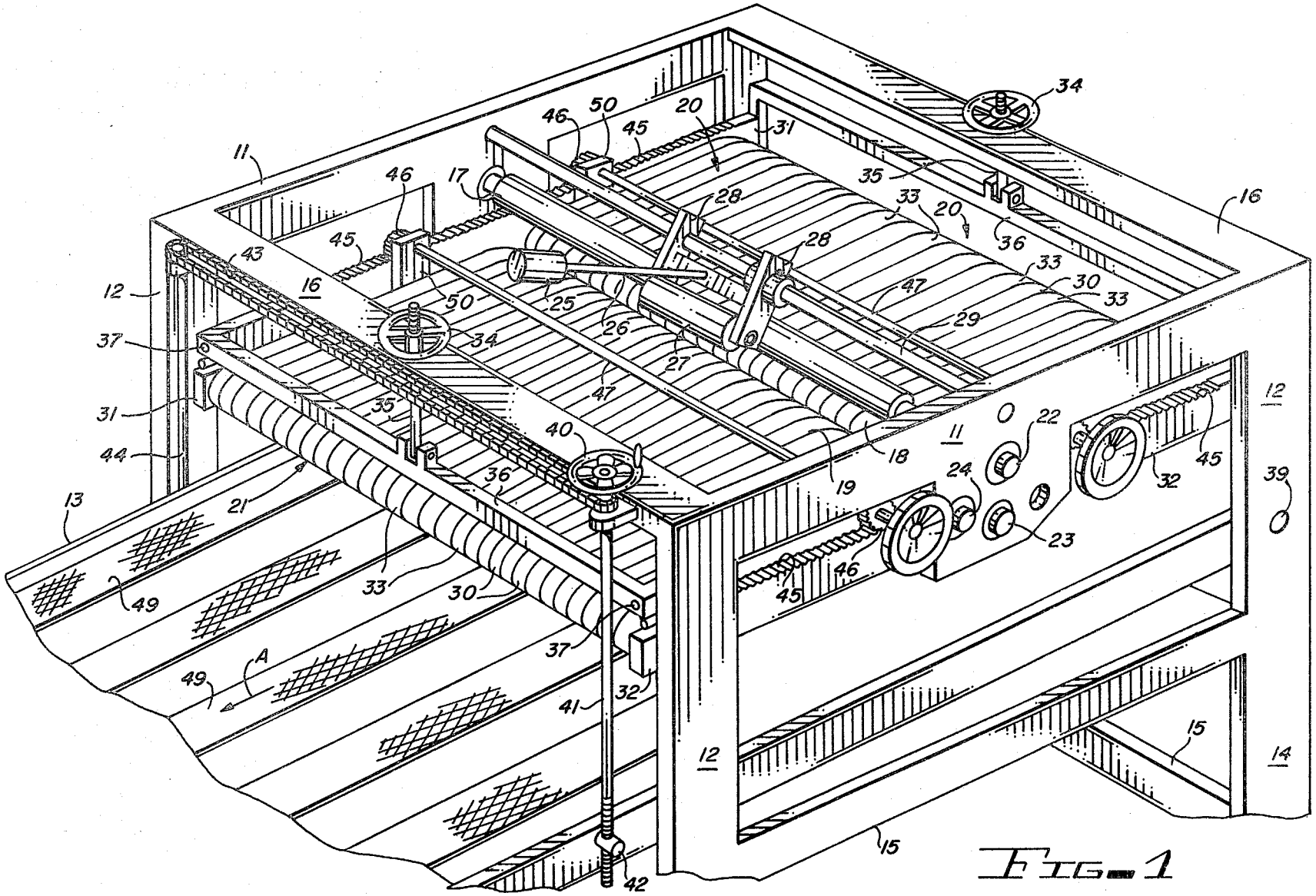
FIG. 1 is a perspective view of an improved continuous form belt folding machine which includes the improved paper stop apparatus of the invention.

Turning now to the drawings, which depict the presently preferred embodiment of the invention for the purpose of illustrating the practice thereof and not by way of limitation of the scope of the invention and in which like reference characters identify corresponding parts in the several views, FIG. 1 is a perspective view showing the general arrangement of the elements. A frame consisting of horizontal members 11, 16 and vertical members 12 supports conveyor table 13 and various paper folding mechanisms which will be subsequently described. If desired, the frame 11, 12, 16 may be further provided with suitable support legs 14 and associated horizontal members 15 mounted on casters to raise the entire apparatus to a convenient working height and to provide for moving the machine within a work area.

A continuous strip of paper or other material is directed by dispensing roller 17 between adjacent distribution rollers 18 and 19 of endless belt units 20 and 21. Rollers 17, 18 and 19 are respectively mounted on axles 22, 23 and 24 journalled for rotation in panel members 11 of the frame. Counter weight 25 carried by lever arm 26 maintains roller guide 27 in position against paper 80 drawn over feed roller 17. Roller guide 27 is rotatably carried by support arms 28 pivotally mounted on transverse rod 29 secured in panel members 11.

Endless belt units 20 and 21 each include an outer roller 30 rotatably supported by parallel frame members 31 and 32. Endless belts 33 interconnect roller pairs 18, 30 and 19, 30. Rollers 18 and 19 are rotated by the gear train of the apparatus (not shown for the sake of clarity). The angle of attack of each endless belt unit is adjusted by turning internally threaded handle 34 which receives the threaded end of rod 35. Rods 35 are pivotally attached to elongate frame members 36 secured to members 31, 32 by threaded nuts 37.

The upper end of conveyor table 13 pivots about rod 39 secured in frame members 12. Belts 49 carry folded paper dispensed by belt units 20 and 21 in the direction of arrow A. The slope of table 13 may be adjusted by turning handle 40 causing the threaded end of rod 41 to raise or lower internally threaded member 42 which is pivotally attached to table 13. Continuous chain 43 is also actuated by rotating handle 40 and similarly rotates the threaded end of rod 44 to displace threaded member 42 (not visible) connected to the opposite edge of table 13.

The upper edges of belt unit frame members 31 and 32 are provided with toothed tracks 45 for receiving gear wheels 46 which are rotatably secured to rods 47. Handles 48 may be used to rotate rods 47 and attached wheels 46 and, as a result, to laterally displace support members 50 carrying paper stop assemblies 51, 56 and tamping mechanisms 52 (not visible in FIG. 1).

Figure 2:
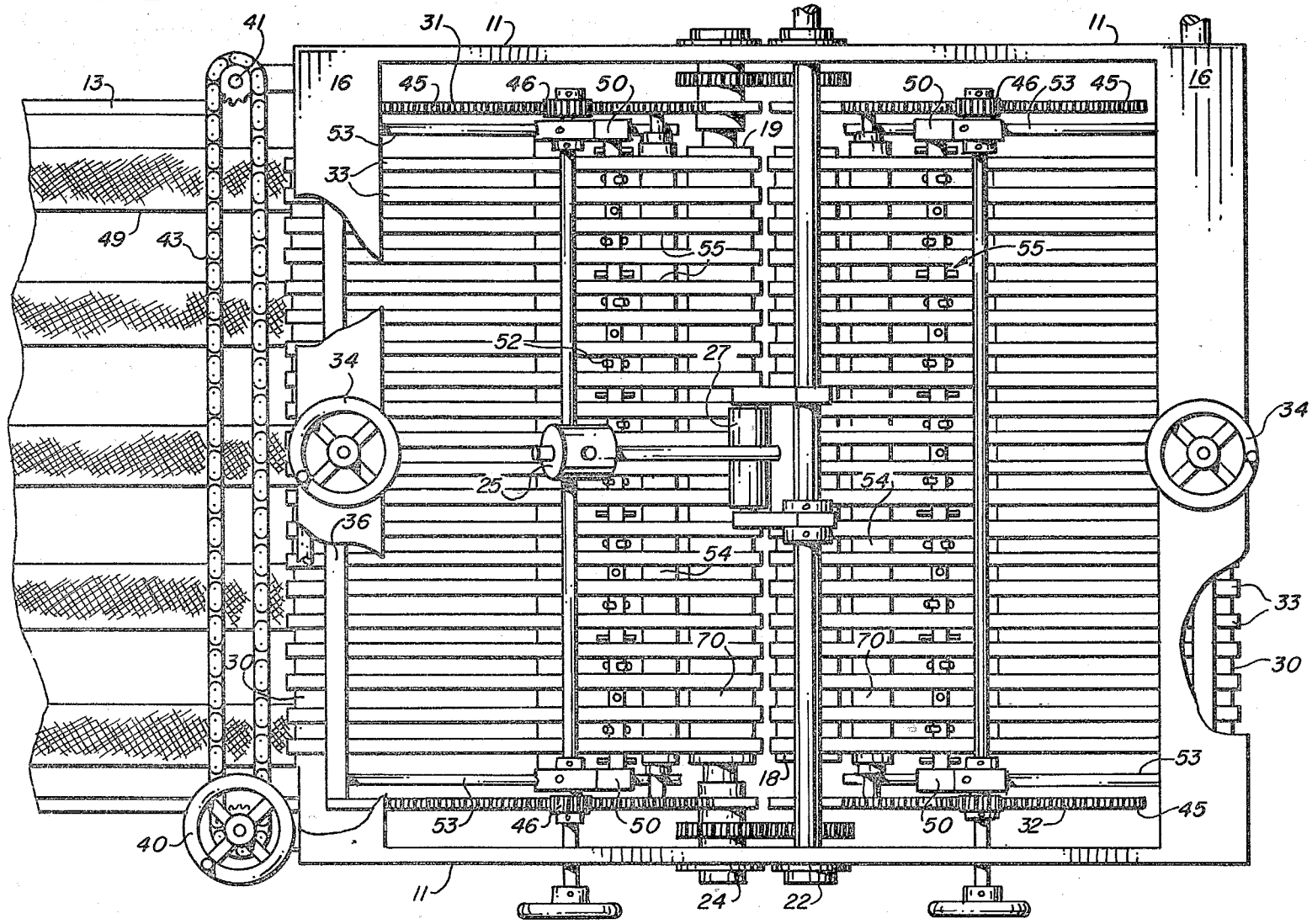
FIG. 2 is a top view of the improved continuous form belt folding machine which includes the improved paper stop adjustment mechanisms of the invention.
Figure 3:
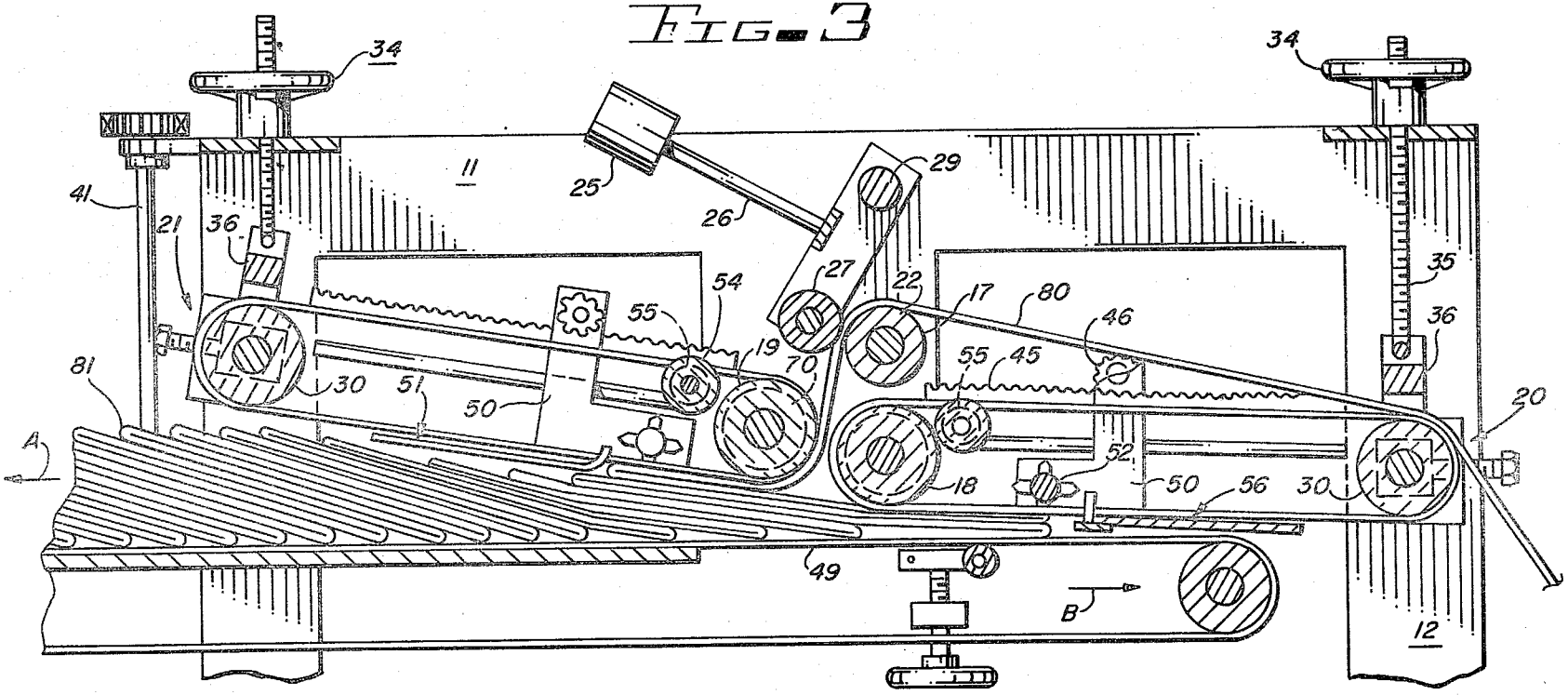
FIG. 3 is a schematic sectional view taken from the right hand side of the paper folding machine of FIG. 1 illustrating the improved paper stop assemblies and mode of operation thereof.
Figure 4:
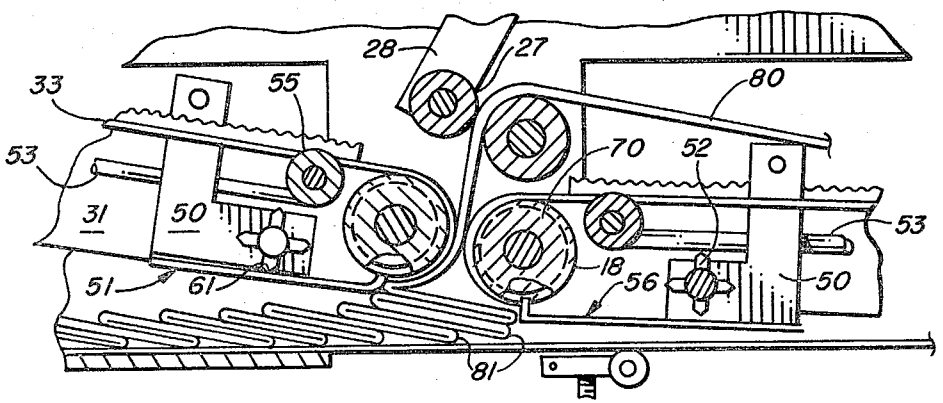
FIG. 4 is a partial schematic sectional view taken from the right hand side of the paper folding machine of FIG. 1 further illustrating the mode of operation of the improved paper stop adjustment mechanisms.

As shown in FIGS. 2, 3 and 4, support members 50 track along guide rails 53. Guide rollers 54 are rotatably carried by belt unit frame members 31 and 32 and are provided with a plurality of individual circumferential grooves 55 which receive belts 33 and maintain the spacing of belts 33 along distribution rollers 18 and 19.

As illustrated in FIGS. 3–7, paper stop assembly 51 is generally U-shaped and includes transverse member 60 provided with legs 61 having apertures 62 and 63 (not visible in FIG. 5) for detachably fixedly connecting paper stop 51 to adjustable L-shaped support members 50 with threaded nuts 64. Internally threaded apertures 65 in support members 50 receive the externally threaded stems of nuts 64. Paper stop assembly 51 is further provided with upwardly depending teeth 58 having vertical faces 59 which receive and stop the lateral travel of creased edges 81 of paper 80 distributed by endless belt units 20 and 21. The lower portions of teeth 58 curve downwardly away from crease engaging faces 59 to accomodate the travel of folded paper along conveyor belts 49 in the direction of arrow A.

Paper stop assembly 56 is also generally U-shaped and includes transverse member 66 and depending legs 67 having apertures 62 and 63 for detachably fixedly connecting paper stop 56 to L-shaped support members 50 with threaded nuts 64. Member 66 is provided with upwardly projecting depending teeth 68 having vertical faces 69 for receiving and stopping the lateral travel of creased edges of paper 80 distributed by endless belt units 20 and 21.

When paper stop assemblies 51 and 56 are attached to support members 50 by inserting threaded bolts 64 through apertures 62 and securing the stems of the bolts 64 in members 50, the paper stop assemblies 51, 56 are located in a conventional position with respect to distribution rollers 18, 19, ie., a tamping mechanism 52 is interposed between each stop assembly 51, 56 and its respective distribution roller 19, 18. When the paper folding machine is in this configuration, it can only fold paper into segments having "longer" lengths. Normally this means the folds must be seven inches or longer.

Conversely, when paper stop assemblies 51 and 56 are attached to support members 50 by inserting threaded bolts 64 through apertures 63 the vertical crease engaging faces 59, 69 of stop assemblies 51, 56 are located between tamping mechanisms 52 and an imaginary midline lying between and parallel to distribution rollers 18 and 19. When paper stop assemblies 51 and 56 are so attached, crease receiving faces 59, 69 of the stop assemblies can be positioned beneath distribution rollers 18, 19 so that a strip of paper can be folded into segments having a length generally equivalent to or less than the sum of the diameters of adjacent rollers 18, 19.

Figure 5:
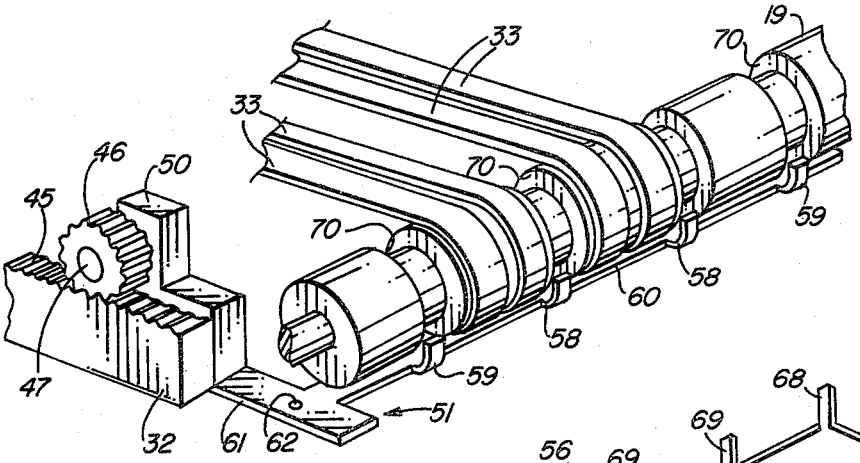
FIG. 5 is a larger scale perspective view of a portion of the paper folding machine of FIG. 1 illustrating the interrelationship of a distribution roller and paper stop assembly.

FIG. 5 illustrates the circumferential grooves 70 provided distribution rollers 18, 19. Grooves 70 define spaces which accept the upper portions of teeth 58, 68 when faces 59, 69 thereof are positioned directly beneath rollers 18, 19. The time and expense involved in machining grooves 70 in rollers 18 and 19 could be avoided by simply shortening the height of teeth 58, 68. However, when this is done, creased edges 81 of paper 80 dispensed by endless belt units 20, 21 have a tendency to travel between the upper tips of teeth 58, 68 and rollers 18, 19 and to foul the machine when the teeth are positioned beneath rollers 18, 19 for short folds. This problem is essentially eliminated by retaining the normal height of teeth 58, 68 and providing rollers 18, 91 with circumferential grooves 70. Maintaining the normal height of teeth 58, 68 is also desirable because the increased height permits the paper stops 51, 56 to better function when paper is folded into longer length segments.

Figure 7:
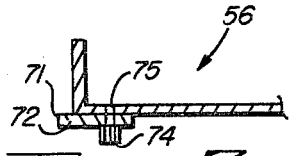
FIG. 7 is a sectional side view of the paper stop assembly of FIG. 6.
Figure 6:
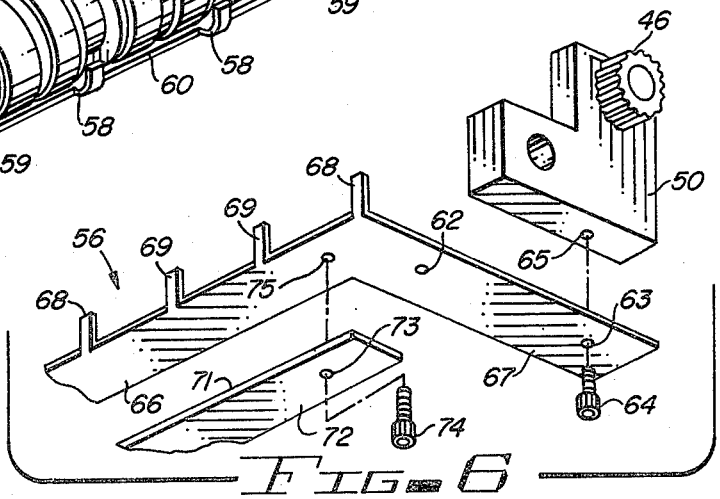
FIG. 6 is a larger scale perspective view of a portion of the paper folding machine of FIG. 1 illustrating the attachment of a paper stop assembly to an adjustable support mechanism.
Figure 10:
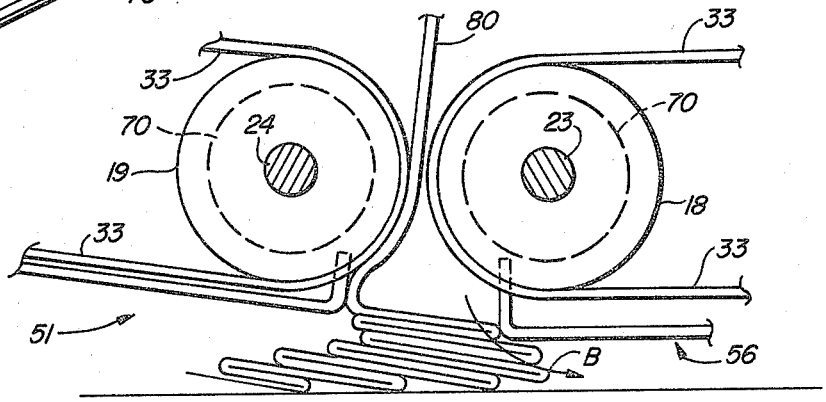
FIG. 10 is a partial schematic sectional view taken from the right hand side of the paper folding machine of FIG. 1 further illustrating the mode of operation thereof.

When vertical faces 69 of stop assembly 56 are positioned beneath roller 18 for folding paper into relatively short segments, creased edges distributed toward faces 69 tend to travel beneath members 66, 67 in the direction of arrow B in FIGS. 3 and 10. Providing stop assembly with a lip at the base of teeth 68 tends to eliminate this problem. As shown in FIGS. 6 and 7, the lip 71 is formed by attaching elongate panel member 72 having apertures 73 therealong to member 66. Apertures 73 and internally threaded apertures 75 in member 66 receive the threaded stems of bolts 74.

Figure 9:
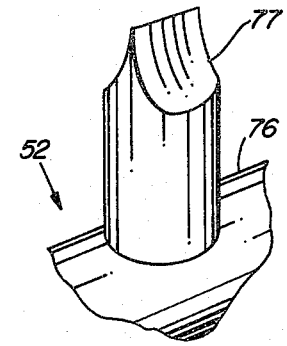
FIG. 9 is an enlarged perspective view of a portion of the paper tamping mechanism of FIG. 8.
Figure 8:
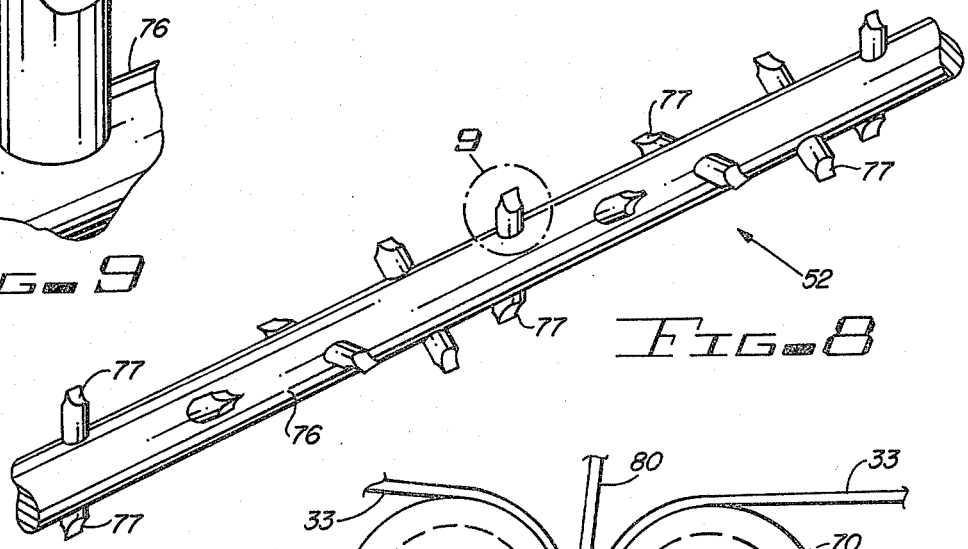
FIG. 8 is a partial perspective view of a paper tamping mechanism of the continuous form belt folding machine of FIG. 1.

As is illustrated in FIGS. 8 and 9, each tamping mechanism 52 includes a rod 76 provided with outwardly projecting diametrically opposed pairs of fingers 77. Rods 76 are rotated by the gear train of the paper folding machine.

In operation, as shown in FIGS. 3 and 4, roller 17 directs a continuous strip of paper between belt units 20, 21 which, together with table 13, function to distribute successive lines of weakening in the paper in substantially opposite directions. Stop assemblies 51, 56 halt the lateral movement of the creased edges of paper distributed by belt units 20, 21 while tamping mechanisms 52 periodically compress paper 80 to assist in folding and positioning the paper on table 13. Conveyors 49 transport folded paper to a packaging and storage station. When folds of normal length, typically 7 inches or more, are desired, stop assemblies 51, 56 are attached to support units 50 by inserting the stems of connecting bolts 64 through apertures 62 and into internally threaded apertures 65. When shorter folds, typically in the range of 1.5 to 5 inches, are desired, stop assemblies 51, 56 are attached to support units 50 by inserting the stems of connecting bolts 64 through apertures 63 and into internally threaded apertures 65.

As would be appreciated by those of skill in the art, a variety of mechanisms could be employed for adjustably attaching paper stop assemblies 51, 56 to support members 50 or for attaching lip 71 to stop assembly 56. In addition, what constitutes a normal or short fold length will, of course, vary from machine to machine depending on factors such as the diameters of the distribution rollers 18, 19.

The electric motor or other power means and the gearing used to transmit motive power to the apparatus described above are generally not shown so as to avoid complication of the drawings. A wide variety of arrangements for powering and gearing such apparatus is known in the art.

Having described my invention in such terms as to enable those persons skilled in the art to which it pertains to understand and practice it, and having identified the presently preferred embodiment thereof, I claim:

1. In combination with apparatus for producing continuous form stationery by folding a strip of paper along transverse lines of weakening formed therein, said apparatus including, a frame;

generally horizontally disposed endless belt means mounted on said frame for alternately distributing said successive lines of weakening in said paper in substantially opposite lateral directions of travel to form creased edges in said paper along said lines of weakening, said belt means including a pair of spaced adjacent parallelably disposed paper distribution rollers, each of said rollers having a generally constant diameter along the length thereof, and a longitudinal axis about which said rollers rotate, said longitudinal axes being generally horizontally disposed; and, belts trained around said distribution rollers;

means carried on said frame for directing said continuous strip of paper between said distribution rollers and into contact with at least some of said belts for said lateral distribution in said substantially opposite directions, said lateral distribution directions being generally perpendicular to said longitudinal axes of said distribution rollers;

a support surface for receiving paper distributed by said endless belt means;

a pair of opposed assemblies carried by said frame and positioned above said support surface, and laterally from said distribution rollers for periodically tamping said paper dispensed from said paper distribution rollers of said endless belt means to assist in folding and positioning said paper on said support surface, each of said tamping assemblies being spaced apart from the other, and located on an opposite side of an imaginary midline lying between and generally parallel to the longitudinal axes of said adjacent distribution rollers;

a pair of opposed paper stop assemblies carried for movement independently of said distribution rollers and opposed assemblies on said frame and positioned above said support surface, and laterally from said distribution rollers and said imaginary midline, each of said paper stop assemblies being spaced apart from the other, and located on an opposite side of said imaginary midline, and having at least one upstanding face for stopping said lateral travel of creased edges of paper distributed away from said midline by said endless belt means;

wherein the improvement comprises means for mounting said upstanding faces of said paper stop assemblies for movement between at least two operative positions, (a) a first operative position with each of said faces of said paper stop assemblies positioned beneath and laterally adjacent one of said distribution rollers, and (b) a second operative position with said faces moved laterally from said first position adjacent said distribution rollers in a direction of travel away from said imaginary midline, such that said continuous form stationery folding apparatus can fold paper in lengths generally equal to or less than the sum of said diameters of said adjacent rollers, said tamping assemblies being positioned laterally out from underneath said distribution rollers when said paper stop assemblies are in said first operative positions.

2. In combination with apparatus for producing continuous form stationery by folding a strip of paper along transverse lines of weakening formed therein, said apparatus including, a frame;

generally horizontally disposed endless belt means mounted on said frame for alternately distributing said successive lines of weakening in said paper in substantially opposite lateral directions of travel to form creased edges in said paper along said lines of weakening, said belt means including a pair of spaced adjacent parallelably disposed paper distribution rollers, each of said rollers having a generally constant diameter along the length thereof, and a longitudinal axis about which said rollers rotate, said longitudinal axes being generally horizontally disposed; and, belts trained around said distribution rollers;

means carried on said frame for directing said continuous strip of paper between said distribution rollers and into contact with at least some of said belts for said lateral distribution in said substantially opposite directions, said lateral distribution directions being generally perpendicular to said longitudinal axes of said paper distribution rollers;

a support surface for receiving paper distributed by said endless belt means;

a pair of opposed paper stop assemblies carried for movement independently of said distribution rollers on said frame and positioned above said support surface, and laterally from said distribution rollers and said imaginary midline, each of said paper stop assemblies being spaced apart from the other, and located on an opposite side of said imaginary midline, and having at least one upstanding face for stopping said lateral travel of creased edges of paper distributed away from said midline by said endless belt means;

wherein the improvement comprises means for mounting said upstanding faces of said paper stop assemblies for movement between at least two operative positions, (a) a first operative position with each of said faces of said paper stop assemblies positioned beneath and laterally adjacent one of said distribution rollers, and (b) a second operative position with said faces moved laterally from said first position adjacent said distribution rollers in a direction of travel away from said imaginary midline, such that said continuous form stationery folding apparatus can fold paper in lengths generally equal to or less than the sum of said diameters of said adjacent rollers.

* * * * *